US005547399A

United States Patent [19]

Naghi et al.

[11] Patent Number: 5,547,399

[45] Date of Patent: Aug. 20, 1996

[54] UNIVERSAL AC ADAPTOR FOR CONSUMER ELECTRONICS

[76] Inventors: Herschel Naghi, 1616 Blue Jay Way, Los Angeles, Calif. 90069; David E. Naghi, 6630 Moore Dr., Los Angeles, Calif. 90048

[21] Appl. No.: 395,751

[22] Filed: Feb. 27, 1995

[51] Int. Cl.[6] ..... H01R 9/11

[52] U.S. Cl. ..... 439/623; 439/639; 439/502

[58] Field of Search ..... 439/170–173, 439/502, 505, 623, 638, 639, 640, 945; D13/110

[56] References Cited

U.S. PATENT DOCUMENTS

| | | | |
|---|---|---|---|
| 2,276,902 | 3/1942 | Webber | 174/105 |
| 2,674,684 | 4/1954 | Duncan | 219/46 |
| 3,504,169 | 3/1970 | Freeburger | 240/10 |
| 3,984,622 | 10/1976 | Ross | 174/72 A |
| 4,099,824 | 7/1978 | Schoppelrey | 339/157 |
| 4,477,801 | 10/1984 | Robinson, Jr. et al. | 340/684 |
| 4,971,576 | 11/1990 | Thimmesch | 439/502 |
| 5,203,720 | 4/1993 | Zini | 439/502 |
| 5,234,360 | 8/1993 | Kramer, Jr. | 430/505 |

OTHER PUBLICATIONS

AC adapters on p. 318 of Hong Kong Enterprise, Oct. 1993.

*Primary Examiner*—David L. Pirlot
*Assistant Examiner*—Brian J. Biggi
*Attorney, Agent, or Firm*—Poms, Smith, Lande & Rose, Professional Corporation

[57] ABSTRACT

A universal AC adaptor has a transformer unit for converting standard AC line voltage to DC voltage and a plurality of plugs. Each plug has a flexible lead coupled to an output cord from the transformer unit at a coupler box. The leads allow the plugs to move independently of one another. Each plug also has a socket having a particular configuration which is different from the sockets of all the other plugs. Each socket is configured to mate with a particular receiving socket of a DC or an AC electrical appliance. The AC adaptor has enough plugs so as to be useable with most of the models of electrical appliance of a particular consumer electronic market, for example, video game units.

10 Claims, 2 Drawing Sheets

UNIVERSAL AC ADAPTOR FOR CONSUMER ELECTRONICS

FIELD OF THE INVENTION

The present invention relates to AC adaptors, particularly AC adaptors for use with consumer electronics such as home video games.

BACKGROUND OF THE INVENTION

Many different consumer electronic products are powered by direct-current (DC) voltage, as well as alternating-current,(AC) voltage. However, standard line voltage available from wall outlets is AC. Therefore, the AC voltage must be convened to a DC voltage by an AC adaptor to be used in these electronic products.

AC adaptors convert AC voltage (for example, 110 volts at 60 Hertz) from a standard wall outlet to a DC voltage (for example, 12 volts) which is useable by an electronic product such as a calculator, portable stereo, video game, and so on.

AC adaptors generally include a plug which plugs into a wall outlet, a transformer which steps the line voltage down, a rectifier circuit which rectifies the stepped-down AC voltage to a DC voltage, and a plug which plugs into an electronic product.

As AC adaptors are so widely used, numerous types of adaptors have been developed, each having a rated voltage for a particular product and each having a plug which has a particular configuration only engageable with a compatible socket of that particular product. Accordingly, a consumer often needs a separate AC adaptor for each electronic product in use, that is, an AC adaptor for use with a calculator is not necessarily compatible with a portable stereo. Furthermore, a consumer must ensure that the plug has a compatible configuration to the socket in the electronic product, even though the voltage is compatible.

Although a compatible AC adaptor is usually included with the purchase of an electronic product, the AC adaptor may need replacing. The consumer must then be sure to purchase a replacement AC adaptor that is compatible with the product.

Furthermore, manufacturers of AC adaptors, particularly those adaptors for the replacement market, have to manufacture separate adaptors for each plug configuration. Many times for a particular electronic industry, for example, home video games, the same DC voltage is used by most of the manufacturers in that particular industry with the only difference being in the configuration of the plug or socket. Therefore, as much of the cost in producing an AC adaptor is tied up in material and labor in assembling the transformer unit, and as the plug or socket is often the only alteration between different adaptors, costs could be substantially reduce by producing a universal AC adaptor which is compatible with most of the video game units on the market at any given time.

One example of such an adaptor has a plug unit with three sockets. The plug unit is a singular, rigid body having the connecting plugs or sockets offset from each other by 90 degrees; i.e., they are perpendicular to each other.

However, because of the geometrical configuration, this type of adaptor is limited in the number of sockets which can be disposed on the plug unit, specifically three or possibly four sockets. If there were more than four sockets, then the angle between adjacent sockets would be less than 90 degrees, and one socket would obstruct the process of inserting another into an electrical appliance by making contact with the appliance itself. Furthermore, this type of adaptor can only be used with one electrical appliance at any given time as the sockets are fixed and unable to move independently.

Therefore, there is an unfulfilled need in the art of AC adaptors for an adaptor which is universally applicable to a particular consumer electronic market, is flexible in its utility, and is able to be used with more than one electrical appliance at the same time.

SUMMARY OF THE INVENTION

According to a primary aspect of the present invention, a universal AC adaptor is useable with most of the models of electrical appliances for a given consumer electronic market, for example, video game units.

The AC adaptor generally has a transformer unit and a plurality of plugs. The transformer unit has a transformer coupled at the primary winding thereof to a wall plug and at the secondary winding thereof to a rectifier circuit. The transformer steps down the standard AC line voltage, and the rectifier circuit rectifies the stepped-down voltage to a DC voltage. An output cord is coupled to the output of the rectifier circuit and to a coupler box. Each plug has a flexible lead cord coupled to the output cord at the coupler box. The lead cords allow the plugs to move independently of one another.

Each plug also has a socket having a particular configuration defined by diameter and voltage polarity which is different from other sockets. Each socket is configured so as to mate with a receiving socket of a particular video game unit. There are as many plugs as necessary to enable the AC adaptor to be useable with most models of video game units on the market.

Another aspect of the present invention is that more than one electrical appliance may be powered .by the universal AC adaptor. For example, the AC adaptor may be used to power a video game unit as well as a CD-ROM drive, or to power two different video game units.

Additional objects, advantages and features of the invention will become apparent upon examination of the following detailed description and the accompanying drawings.

DETAILED DESCRIPTION OF THE PREFERRED EMBODIMENTS

Figure 1:
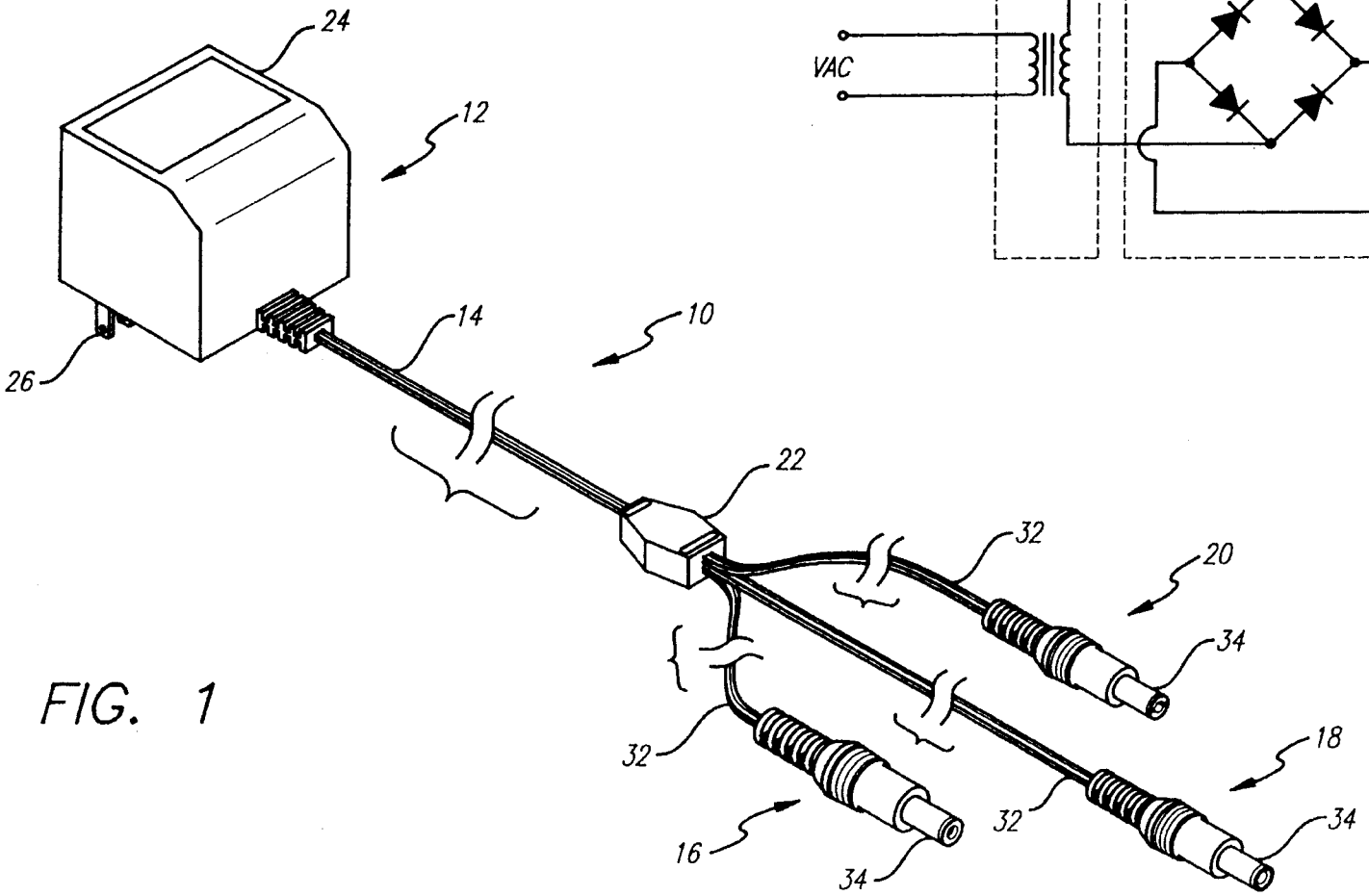
FIG. 1 is a perspective view of a universal AC adaptor illustrating the principles of the present invention.

Referring to the drawings, particularly to FIG. 1, a universal AC adaptor 10 according to a preferred embodiment of the present invention is shown in perspective. The adaptor 10 generally includes a transformer unit 12, an output cord 14 coupled to electronics within the transformer unit 12, and a plurality of plugs 16, 18, and 20 coupled to the output wire 14 at a coupler box 22.

The transformer unit 12 has a housing 24 and is plugged into a wall outlet by means of a standard wall plug 26. The plug 26 may either be contained within the housing 24 or external and connected thereto by means of a standard electrical cord. Typically, in the U.S., line voltage in a wall outlet is rated at 110 volts alternating current (AC) at 60 Hertz. However, the present invention may be modified so as to be adaptable to line voltages in other countries, e.g., 220 volts at 50 Hertz. Additionally, the wall plug 26 may be of a configuration compatible with standard wall outlets of other countries.

Figure 2:
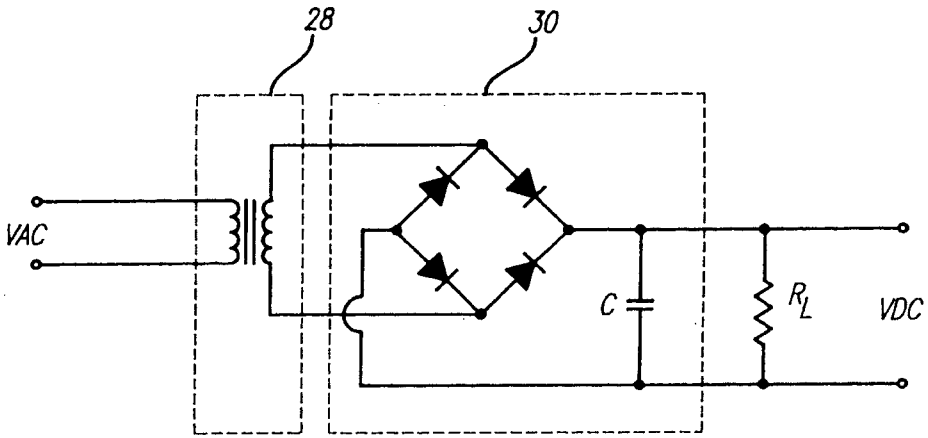
FIG. 2 is a circuit diagram of the universal AC adaptor of FIG. 1.

Additionally referencing FIG. 2, a circuit diagram of the electronics of the transformer unit 12 is shown. The wall plug 26 is coupled with the primary winding of a transformer 28 by means of a standard electrical cord. The input voltage VAC is stepped down by the transformer 28 and then rectified to a direct-current (DC) voltage VDC by a rectifier circuit 30 generally consisting of a full-wave bridge rectifier and a capacitive filter. The output cord 14 is coupled to the VDC output of the circuit. The transformer 28 and the rectifier circuit 30 are designed to provide a desired DC voltage to the output cord 14 and, accordingly, to an electronic appliance by means of the plugs 16–18., taking into consideration the load resistance $R_L$ of the appliance.

Each of the plugs 16–20 has a flexible lead 32 coupled thereto which is in turn coupled to the output cord 14 at the coupler box 22. The coupler box 22 ensures that the polarity of the output cord 14 matches the polarity of each of the leads 32; that is, the positive wire of the output cord 14 is coupled to each of the positive wires of the leads 32, and the negative wire of the output cord 14 is coupled to each of the negative wires of the leads 32.

Each of the flexible leads 32 has a sufficient length so as to allow the plugs 16–20 to move independently of the others. Therefore, each of the leads 32 should be at least approximately two and one-half centimeters long, but is preferably approximately five centimeters long or more. The length of the leads 32 can be made any suitable length appropriate for a particular market application.

Incidentally, strain-relief bushings may be provided for the output cord 14 at the transformer unit 12 and at the coupler box 22, and strain-relief bushings may be provided for the leads 32 at the coupler box 22 and at each of the plugs 16–20.

Depending upon the particular electronic market in which the adaptor 10 is to be used, each of the plugs 16–20 has a connector or socket 34 projecting therefrom. For the home video game market, the sockets 34 are of the type having an outer conductive lead and a central conductive lead. Depending upon the particular consumer electronic appliance, the conductive leads have either a positive or a negative voltage polarity; that is, each conductive lead is respectively coupled to either the positive or the negative wire of the lead 32.

The sockets 34 are engageable with receiving sockets disposed in consumer electronic appliances. But different manufacturers of consumer electronics use different configurations for receiving sockets disposed in the electronic unit itself, in that one particular socket 34 is not engageable with all receiving sockets found in consumer electronic appliances. Therefore, in order to provide an AC adaptor which is engageable with a variety of consumer electronic appliances, the sockets 34 of the adaptor 10 should have different configurations.

In the consumer electronics industry, sockets of AC adaptors generally vary in diameter, in the polarity of the conductive leads, and in the configuration of the socket itself. For example, in the field of home video games, a number of manufacturers employ sockets having specifications outlined in Table I as follows.

TABLE I

| Brand (Registered Trademarks) | Model (Registered Trademarks) | Diameter (mm) | Voltage Polarity Outer | Voltage Polarity Central |
|---|---|---|---|---|
| Sega | Game Gear | 4.75 | (–) | (+) |
| Sega | Genesis (old models) | 5.5 | (+) | (–) |
| Sega | Genesis (new models) | 4.75 | (–) | (+) |
| Sega | CD-ROM Drive | 5.5 | (+) | (–) |
| Nintendo | Super NES | 6.9 | (+) | (–) |
| JVC | JVC X Eye | 4.75 | (–) | (+) |

In order to provide an AC adaptor which is useable with most home video game units, an AC adaptor should have plugs with configurations which are compatible to the receiving sockets of the video game units. Therefore, in accordance with one preferred embodiment of the present invention, each one of the plugs 16–20 of the adaptor 10 is respectively configured so as to be compatible with one of the home video game systems listed in Table I, such that the adaptor 10 is universally applicable to most systems and accessories on the home video game market.

If an additional home video game unit or accessory were to become available on the market which had yet a different receiving socket configuration than any of those listed in Table I, then an additional plug could be added to the adaptor 10 which would have a configuration compatible with that of the new unit.

Therefore, if a user needs to replace an AC adaptor for a video game, the user does not need to worry about the particularly configuration of his or her home video game system with a purchase of an AC adaptor according to the present invention.

It may be noted that the adaptor 10 is not limited to the three plugs 16–20 as shown in the drawings: the adaptor 10 may have as many plugs as necessary so as to be substantially universal to the products of the particular consumer electronics industry for which the adaptor 10 is designed.

A specific commercial embodiment of the AC adaptor 10 shown for use with the video game market may have the following approximate specifications. The transformer unit 12 has an input rating of 120 volts AC at 60 Hertz and 20 watts and an output rating of nine volts DC at one ampere. The electrolytic capacitor of the rectifier circuit 30 is 2.2 millifarads. The leads 32 are approximately six centimeters to seven centimeters long. The socket 34 of plug 16 is approximately 6.9 millimeters in diameter with a voltage polarity of positive on the outer conductive lead and negative on the central conductive lead. The socket 34 of plug 18 is approximately 5.5 millimeters in diameter with a voltage polarity of positive on the outer conductive lead and negative on the inner conductive lead. And the socket 34 of the plug 20 is approximately 4.75 millimeters in diameter with a voltage polarity of negative on the outer conductive lead and positive on the center conductive lead.

Figure 3:
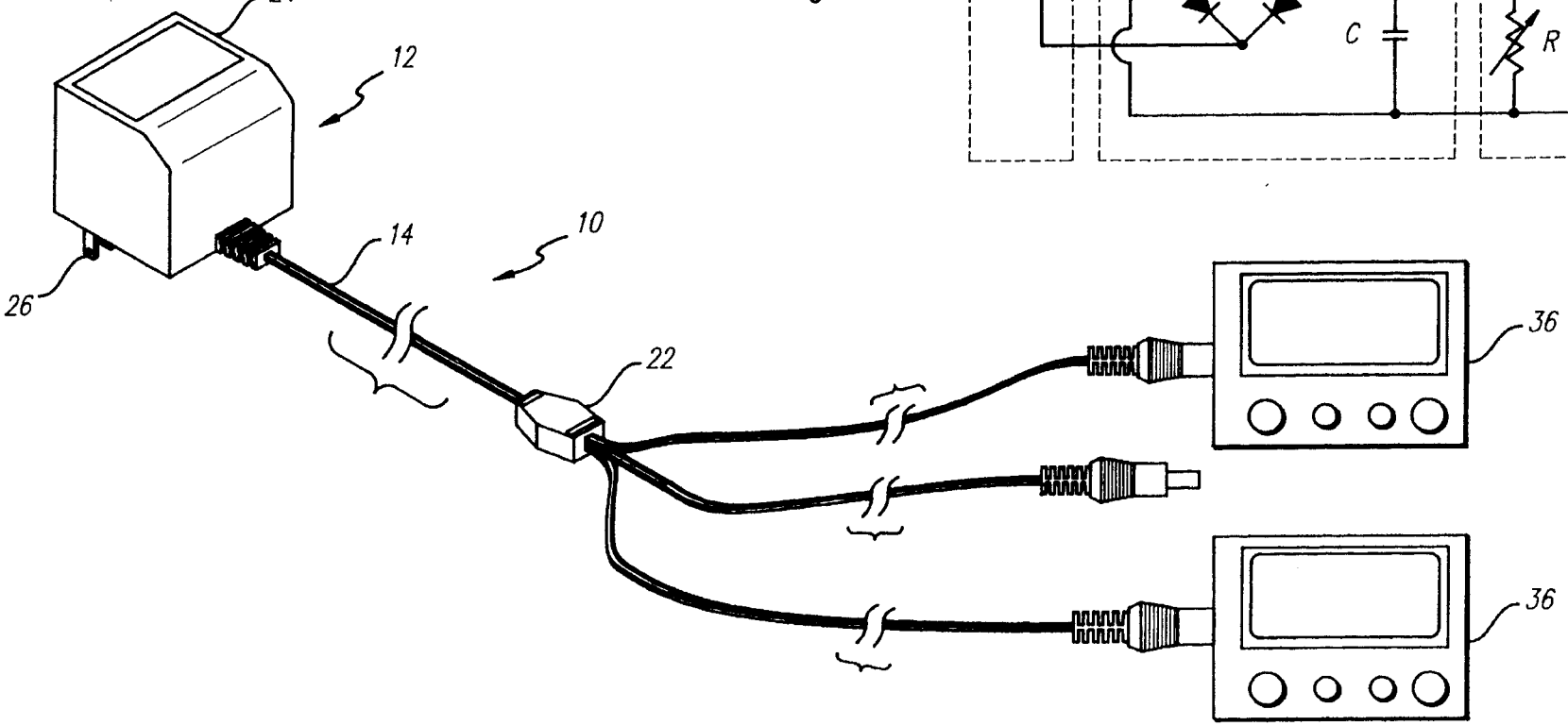
FIG. 3 is a plan view of a universal AC adaptor illustrating another preferred embodiment of the present invention.

In accordance with another preferred embodiment of the present invention, the adaptor 10 is useable with more than one consumer electronic appliance at the same time. With reference to FIG. 3, the adaptor 10 is shown providing power to two electronic appliances 36. In this embodiment the length of the leads 32 is sufficiently great so as to enable two or more of the plugs 16–20 to be engaged with a corresponding number of the appliances 36 simultaneously, for example, at least 15 centimeters.

Figure 4:
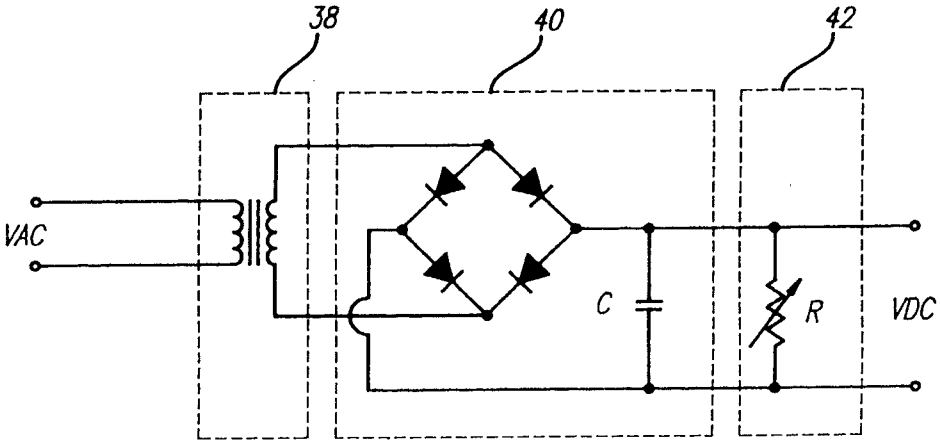
FIG. 4 is a circuit diagram of the universal AC adaptor of FIG. 3.

With reference to FIG. 4, a circuit diagram for the adaptor 10 for driving multiple appliances is shown. A transformer 38 and a rectifier circuit 40 are provided in a similar manner as described above. Additionally, an variable resistor R is coupled in parallel to the output of the rectifier circuit 40 to regulate the input impedance of more than one appliance. The output cord 14 (not shown in FIG. 4) is in turn coupled to the VDC output. In order to drive more than one appliance 36, the transformer 38 and the rectifier circuit 40 are designed to provide more power at the VDC output of the rectifier circuit 40 by using heavier gauge wire and a larger core, for example, in accordance with transformer design principles, know per se.

In this disclosure, there is shown and described only the preferred embodiments of the present invention, but it is to be understood that the invention is capable of use in various other combinations and markets and is capable of changes or modification within the scope of the inventive concept as expressed herein. More specifically, the configuration of the plugs 16–20 may be designed to be compatible with any particular electronic appliance, and the transformer unit 12 may be used with and yield any desired voltage, current, and/or power. Further, the leads 32 may be of any length which is suitable for a specific consumer electronic market.

What is claimed is:

1. A universal. AC adaptor for home video games, comprising:

a transformer unit having a housing, a wall plug protruding through said housing and engageable with a standard wall outlet, a transformer having a primary winding and a secondary winding and contained within said housing and coupled to said wall plug at the primary winding thereof for stepping down the AC voltage from the wall outlet, a rectifier circuit contained in said housing and coupled to the secondary winding of said transformer for rectifying the stepped-down voltage to a DC voltage, and a variable resistor connected in parallel to the output of said rectifier circuit;

an output cord having a first end coupled to the output of said rectifier circuit and a second end; and a plurality of at least three plugs, each said plug having a flexible lead coupled to the second end of said output cord and having a connector protruding therefrom;

each said connectors of said plugs having a configuration different from said connectors of the other said plugs, said configuration being defined by diameter and voltage polarity;

each said connector having a configuration which is useable with a particular home video game unit; and first and second home video game units coupled respectively to first and second plugs of said plurality of plugs;

whereby said adaptor is useable with most home video game units in that said plurality of plugs have configurations compatible with most home video game units on the market.

2. A universal AC adaptor as claimed in claim 1, wherein each said lead is at least approximately 15 centimeters long.

3. A universal AC adaptor as claimed in claim 1, wherein said connectors are in the form of sockets having an outer conductive lead and a central conductive lead;

one of said connectors having a diameter of approximately 6.9 millimeters and a voltage polarity of positive on the outer conductive lead thereof and negative on the central conductive lead thereof;

one of said connectors having a diameter of approximately 5.5 millimeters and a voltage polarity of positive on the outer conductive lead thereof and negative on the central conductive lead thereof; and one of said connectors having a diameter of approximately 4.75 millimeters and a voltage polarity of positive on the central conductive lead thereof and negative on the outer conductive lead thereof.

4. A universal AC adaptor as claimed in claim 1, wherein said transformer unit steps down 120 volts, alternating current at 60 Hertz, and has a DC output of approximately nine volts and approximately one ampere.

5. A universal AC adaptor for use with a particular consumer electronic market, said adaptor being useable with most models of electrical appliance for said market, comprising:

a wall plug engageable with a wall outlet;

a transformer unit having a housing, a transformer contained within said housing and coupled to said wall plug at the primary winding thereof, and a rectifier circuit contained in said housing and coupled to the secondary winding of said transformer;

an output cord having a first end coupled to the output of said rectifier circuit and a second end;

a coupler box connected to said second end of said output cord;

a plurality of plugs, each said plug having a flexible lead and a socket protruding therefrom, each said lead being coupled to said coupler box;

each said socket having a different configuration from all of the other said sockets, said configuration being defined by diameter and voltage polarity; and each said socket having a configuration which is useable with a particular electronic appliance of said market.

6. A universal AC adaptor as claimed in claim 5, wherein each said lead is at least approximately two and one-half centimeters long.

7. A universal AC adaptor as claimed in claim 5, wherein said universal AC adaptor is adapted to be used with home video games.

8. A universal AC adaptor as claimed in claim 7, wherein:

at least one of said sockets has a diameter of approximately 6.9 millimeters and a voltage polarity of positive on the outer conductive lead thereof and negative on the central conductive lead thereof;

at least one of said sockets has a diameter of approximately 5.5 millimeters and a voltage polarity of positive on the outer conductive lead thereof and negative on the central conductive lead thereof; and at least one of said sockets has a diameter of approximately 4.75 millimeters and a voltage polarity of positive on the central conductive lead thereof and negative on the outer conductive lead thereof.

9. An AC adaptor for use with one or more electronic appliances requiring approximately the same DC voltage, current, and/or power, comprising:

a transformer unit having a housing, a wall plug engageable with a standard wall outlet, a transformer having a primary winding and a secondary winding and contained within said housing and coupled to said wall plug at the primary winding thereof for stepping down the AC voltage form the wall outlet, a rectifier circuit contained in said housing and coupled to the secondary winding of said transformer for rectifying the stepped-down voltage to a DC voltage, and a variable resistor coupled in parallel to the output of said rectifier circuit;

an output cord having a first end coupled to the output of said rectifier circuit and a second end; and a plurality of plugs having a flexible lead coupled to the second end of said output cord and having a socket protruding therefrom, each said plug being independently movable with respect to the other said plugs;

each said socket having a configuration different from at least one other said socket and being useable with an electronic appliance.

10. An AC adaptor as claimed in claim 7, wherein said sockets are configured for a specific consumer electronic market;

said market having electronic appliances with sockets for receiving said sockets, said appliance sockets having configurations different from other said appliance sockets;

the number of said plugs substantially equals the number of different configurations of said appliance sockets.

* * * * *